US012790149B2

(12) United States Patent
Ambe

(10) Patent No.: US 12,790,149 B2
(45) Date of Patent: Nov. 10, 2026

(54) SHEET FEEDER AND IMAGE FORMING APPARATUS

(71) Applicant: BROTHER KOGYO KABUSHIKI KAISHA, Nagoya (JP)

(72) Inventor: Yurimi Ambe, Nisshin (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 162 days.

(21) Appl. No.: 18/947,721

(22) Filed: Nov. 14, 2024

(65) Prior Publication Data

US 2025/0162828 A1 May 22, 2025

(30) Foreign Application Priority Data

Nov. 17, 2023 (JP) ..... 2023-196170

(51) Int. Cl.
*B65H 3/52* (2006.01)
*B65H 3/06* (2006.01)
*B65H 7/02* (2006.01)

(52) U.S. Cl.
CPC ..... *B65H 3/5223* (2013.01); *B65H 3/0607* (2013.01); *B65H 3/0661* (2013.01); *B65H 3/0669* (2013.01); *B65H 3/0684* (2013.01); *B65H 7/02* (2013.01); *B65H 2402/31* (2013.01); *B65H 2403/514* (2013.01); *B65H 2404/153* (2013.01); *B65H 2404/6942* (2013.01); *B65H 2405/10* (2013.01); *B65H 2405/1117* (2013.01); *B65H 2405/354* (2013.01); *B65H 2553/61* (2013.01)

(58) Field of Classification Search
CPC ..... B65H 3/5223; B65H 7/02; B65H 7/20; B65H 2553/61
See application file for complete search history.

(56) References Cited

U.S. PATENT DOCUMENTS 8,534,664 B2 * 9/2013 Yamamoto ..... B65H 3/5223 271/124
9,233,808 B2 * 1/2016 Morimoto ..... B65H 7/02
10,160,613 B2 * 12/2018 Tanaka ..... B65H 3/5223
11,429,051 B2 * 8/2022 Nakata ..... H04N 1/00795

FOREIGN PATENT DOCUMENTS

JP 2021-104893 A 7/2021
JP 2022-85139 A 6/2022

* cited by examiner

*Primary Examiner* — Jeremy R Severson
(74) *Attorney, Agent, or Firm* — Merchant & Gould P.C.

(57) ABSTRACT

A spring is located between a separation pad and a frame. The frame is configured to receive a downward reaction force that is a reaction force of an urging force of a spring. A rotation shaft and a contact piece are located at one side of the separation pad in a width direction. The frame has an upper edge in a first region defined between one end and another end of the rotation shaft in the width direction. A height of the upper edge in the first region is at a same height or below a rotation axis. The frame includes a standing wall in a second region in the width direction. The standing wall extends farther upward than the upper edge in the first region. The second region includes a region in which the separation pad is located. The second region is other than the first region.

14 Claims, 13 Drawing Sheets

SHEET FEEDER AND IMAGE FORMING APPARATUS

This application claims priority from Japanese Patent Application No. 2023-196170 filed on Nov. 17, 2023. The entire content of the priority application is incorporated herein by reference.

BACKGROUND ART

A sheet feeder including a separation roller and a separation pad is known.

SUMMARY

For example, a sheet feeder includes a separation roller, a separation pad, and an urging spring, and also includes a feed guide member as a frame.

The urging spring exerts an urging force to press the separation pad toward the separation roller. The feed guide member supports the separation pad such that the separation pad contacts and separates from the separation roller.

The sheet feeder includes an actuator for detecting a sheet to be fed in the vicinity of the separation pad. The actuator generally has a configuration including a contact piece and a rotation shaft. The contact piece is configured to contact the sheet and pivot about a rotation axis extending in a width direction perpendicular to the feed direction. The rotation shaft rotates together with the contact piece about the rotation axis. The feed guide member rotatably supports the rotation shaft.

In the sheet feeder, the urging spring is positioned between the separation pad and the frame, and the frame receives a downward reaction force which is a reaction force of the urging force. Thus, the frame may be bent downward by receiving the reaction force. When the frame is bent, for example, a problem such as a decrease in the separation performance of the separation roller and the separation pad may occur.

Thus, it is necessary to increase the rigidity of the frame so as to be able to resist the reaction force. For example, it is conceivable to reinforce the frame by providing a standing wall extending upward on the frame.

However, the actuator needs to be disposed in the vicinity of the separation pad in the frame. Thus, it is necessary to shift the position of the standing wall in the feed direction in order to provide the standing wall so as not to interfere with the operation range of the contact piece and the rotation shaft of the actuator. As a result, in the sheet feeder, it may be difficult to suppress an increase in size of the frame in the feed direction.

In view of the foregoing, an example of an object of this disclosure is to provide a sheet feeder in which the rigidity of a frame supporting a separation pad and a rotation shaft of an actuator is increased while suppressing an increase in size in a feed direction.

According to one aspect, this specification discloses a sheet feeder. The sheet feeder includes a separation roller, a separation pad, a spring, an actuator, and a frame. The separation roller is configured to feed a sheet in a feed direction. The separation pad faces the separation roller. The spring is configured to exert an urging force that presses the separation pad toward the separation roller. The actuator is configured to detect the sheet that is fed. The actuator includes a rotation shaft and a contact piece. The rotation shaft has one end and an other end in a width direction perpendicular to the feed direction. The rotation shaft is rotatable about a rotation axis extending in the width direction. The contact piece is configured to contact the sheet and to rotate about the rotation axis together with the rotation shaft. The frame is configured to support the separation pad to contact and separate from the separation roller. The frame rotatably supports the one end and the other end of the rotation shaft. The spring is located between the separation pad and the frame. The frame is configured to receive a downward reaction force that is a reaction force of the urging force. Thus, the frame receives the reaction force from the spring. The rotation shaft and the contact piece are located at one side of the separation pad in the width direction. Thus, the actuator is located at the one side of the separation pad in the width direction. The frame has an upper edge in a first region defined between the one end and the other end of the rotation shaft in the width direction. A height of the upper edge in the first region is at a same height or below the rotation axis. Thus, there is a space for arranging the actuator above the frame in the first region. The frame includes a standing wall in a second region in the width direction. The standing wall extends farther upward than the upper edge in the first region. The second region includes a region in which the separation pad is located. The second region is other than the first region. Thus, the standing wall increases the rigidity of the frame.

In the sheet feeder of the present disclosure, the height of the upper edge in the first region of the frame is lower than or equal to the rotation axis. That is, in the frame, the upper edge in the first region is lowered or the thickness of the upper edge in the first region is reduced so as not to interfere with the operation range of the contact piece and the rotation shaft of the actuator.

The frame includes, in the second region, a standing wall extending farther upward than the upper edge in the first region. That is, the frame is provided with the standing wall in the second region outside the operation range of the contact piece and the rotation shaft of the actuator. Thus, the standing wall does not interfere with the operation range of the contact piece and the rotation shaft regardless of the position of the standing wall in the feed direction.

With this configuration, in the sheet feeder, the standing wall reinforces the frame, and thus the rigidity of the frame is increased so as to resist the reaction force of the urging force. As a result, the frame is less likely to bend downward, and thus, for example, a problem such as a decrease in the separation performance of the separation roller and the separation pad is less likely to occur.

Thus, according to the sheet feeder of the present disclosure, the rigidity of the frame supporting the separation pad and the rotation shaft of the actuator is increased while suppressing an increase in size in the feed direction.

BRIEF DESCRIPTION OF DRAWINGS

FIG. 4 is a perspective view showing a separation pad, an actuator, a frame, a gear frame, a lifter, a feed guide, and so on.

FIG. 5 is a perspective view showing the actuator, the frame, the gear frame, the lifter, the feed guide, and so on.

FIG. 6 is a perspective view showing the actuator, the frame, the gear frame, the lifter, a sensor board, and so on.

FIG. 7 is a perspective view showing the separation pad, the actuator, the frame, and so on.

FIG. 8 is a front view showing the separation pad, the actuator, the frame, the lifter, and so on.

DESCRIPTION

Hereinafter, an embodiment of the present disclosure will be described with reference to the drawings.

Figure 1:
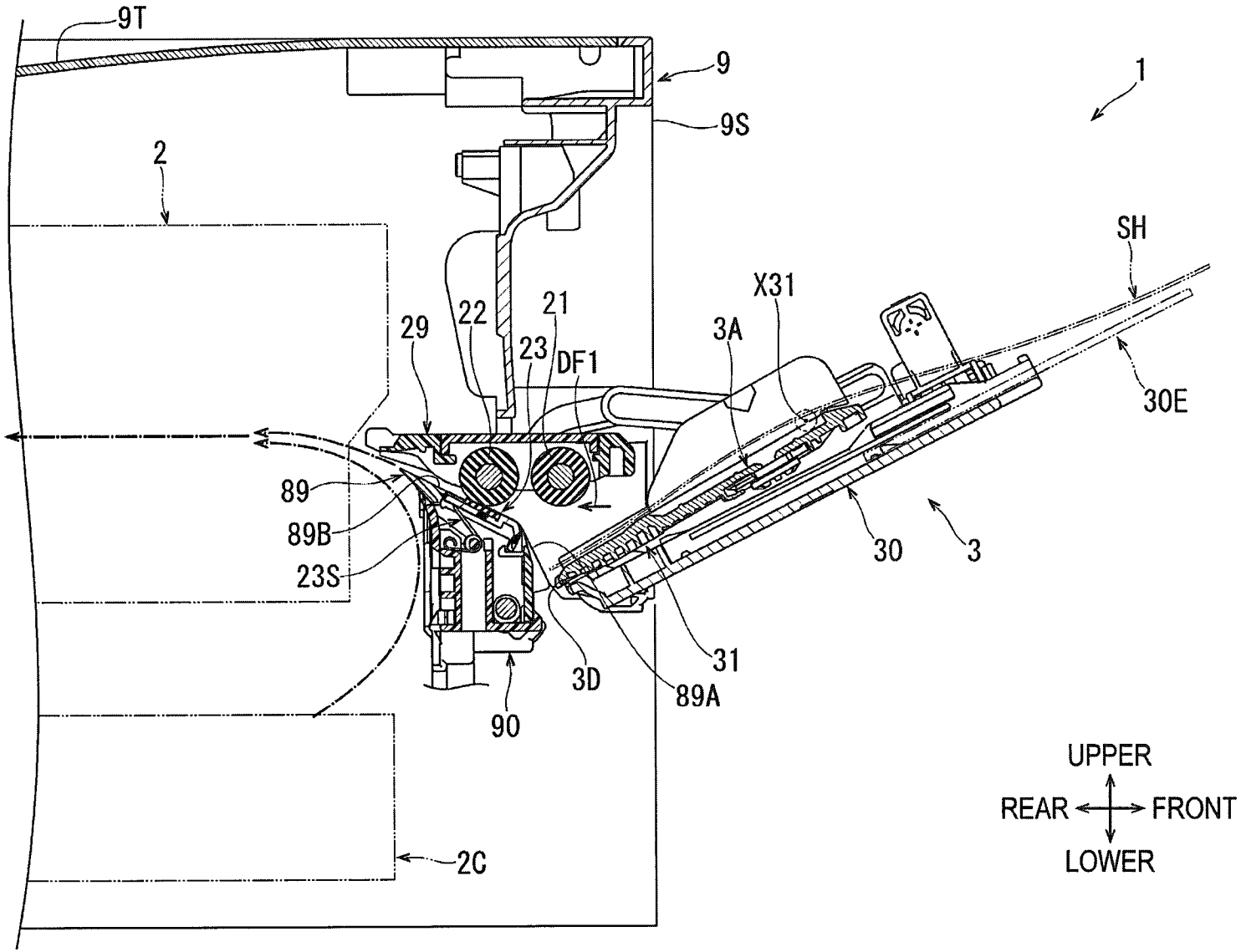
FIG. 1 is a partial cross-sectional view of an image forming apparatus, and mainly shows a state in which a support plate of a pulled-out feed tray is separated downward from a feed roller.

As shown in FIG. 1, an image forming apparatus 1 of the embodiment is an example of a sheet feeder of the present disclosure. In FIG. 1, a side of a front surface 9S of a housing (apparatus main body) 9 is defined as the front of the apparatus, and an upper side of the housing 9 is defined as the upper side of the apparatus. A width direction of the image forming apparatus 1 is a direction perpendicular to a front-rear direction and an upper-lower direction. A side which comes to the right when facing the front surface 9S of the housing 9, that is, a back side of the paper surface of FIG. 1 is defined as one side in the width direction. The "one side" in the drawings means one side in the width direction, and "the other side" means the other side in the width direction. The front-rear direction, the upper-lower direction, and the width direction shown in FIG. 2 and the subsequent drawings are all shown to be consistent with FIG. 1.

As shown in FIG. 1, the image forming apparatus 1 includes the housing 9, a sheet feed cassette 2C, an image forming unit (print engine) 2, and a conveyor (not shown). The housing 9 is substantially box-shaped, and has a discharge tray 9T on its upper surface. The sheet feed cassette 2C is located in a lower portion of the housing 9, and stores a plurality of sheets in a stacked state.

The image forming unit 2 is located in an upper portion of the housing 9. The image forming unit 2 forms an image on a sheet by an electrophotographic method, a thermal method, an inkjet method, or another image forming method.

The conveyor (not shown) supplies sheets one sheet at a time from the sheet feed cassette 2C to the image forming unit 2. The image forming unit 2 forms an image on the sheet. Thereafter, the conveyor (not shown) conveys the sheet on which the image is formed and discharges the sheet to the discharge tray 9T.

The image forming apparatus 1 includes a feed tray 3. The feed tray 3 is a multi-purpose tray for feeding a plurality of types of sheets SH having different sizes, thicknesses, and so on, to the image forming unit 2.

The feed tray 3 is located on the side of the front surface 9S of the housing 9 and is pulled out so as to extend forward from the front surface 9S. Although not shown, the feed tray 3 is accommodated in the housing 9 along the front surface 9S of the housing 9 by being rotated upward and rearward to stand.

Figure 2:
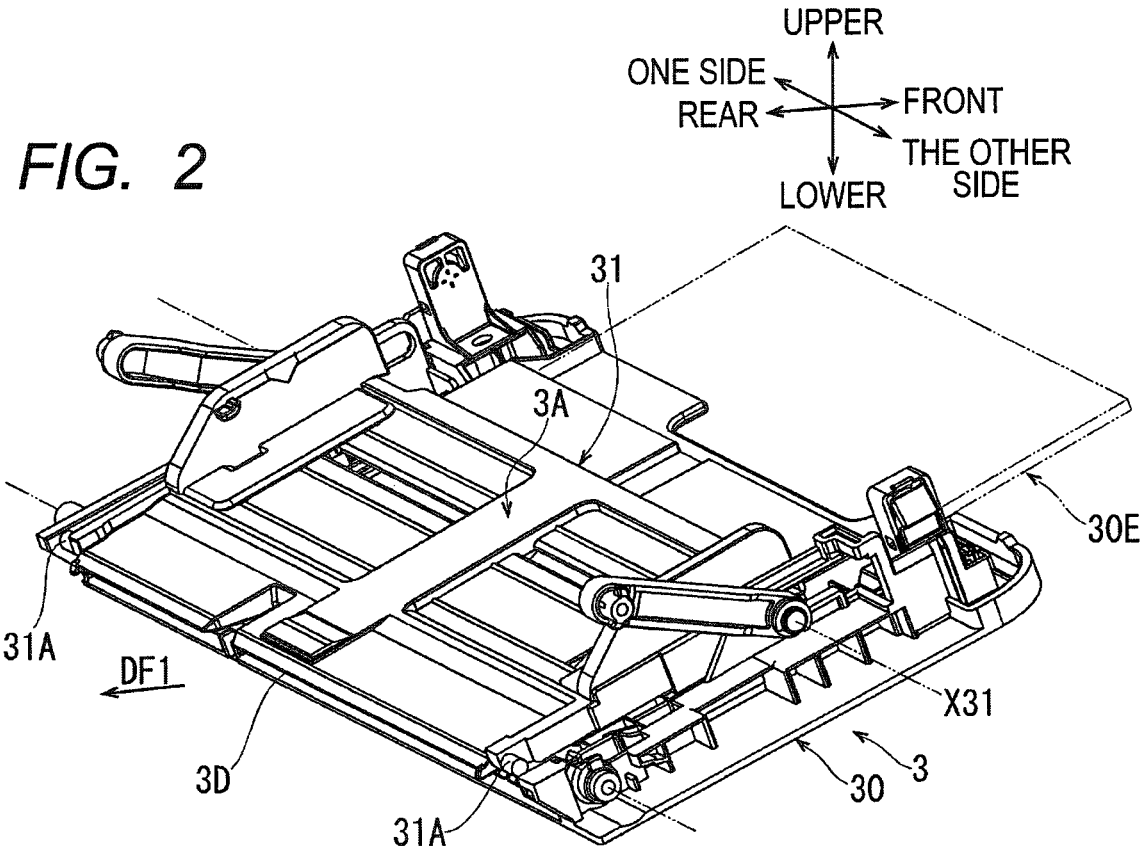
FIG. 2 is a perspective view showing the feed tray.
Figure 3:
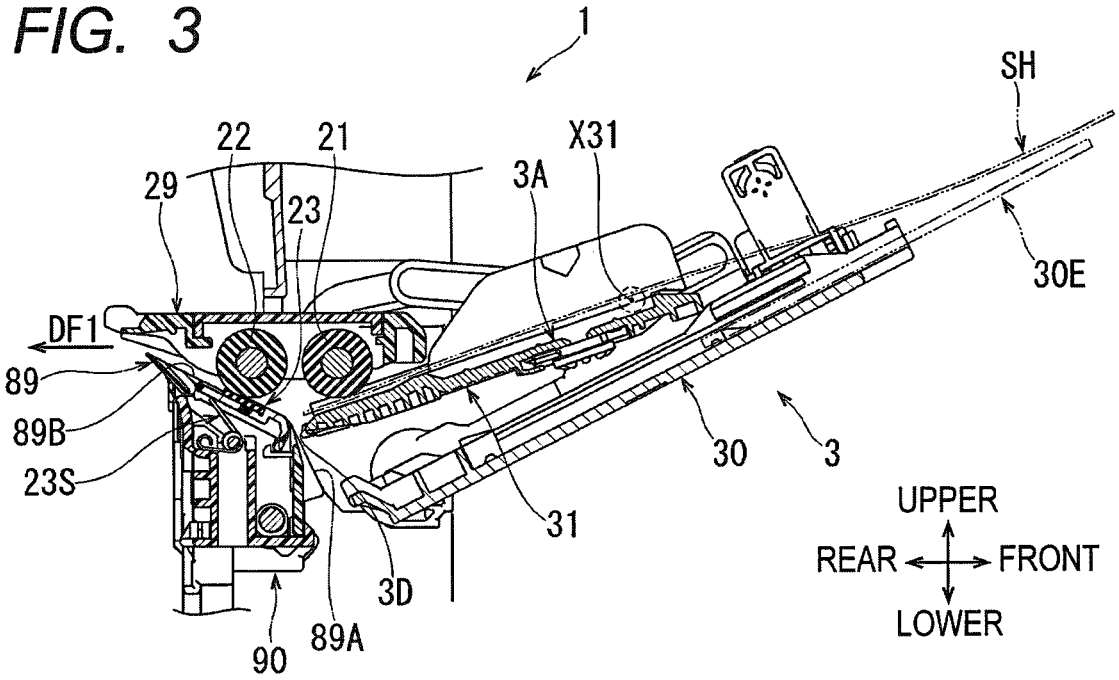
FIG. 3 is a partial cross-sectional view similar to FIG. 1, and mainly shows a state in which a support plate of the pulled-out feed tray is raised and comes into contact with the feed roller.

As shown in FIGS. 1 to 3, the surface of the pulled-out feed tray 3 facing upward is a support surface 3A configured to support the sheet SH. The sheet SH supported on the support surface 3A is fed toward the image forming unit 2 in a feed direction DF1. The feed direction DF1 is a rearward direction along the front-rear direction and is perpendicular to the width direction. The feed tray 3 includes a feed tray main body 30, a support plate 31, and a sub-tray 30E.

The feed tray main body 30 is rotatably supported by the housing 9. In a state where the feed tray 3 is pulled out, the feed tray main body 30 extends so as to be inclined upward from the front surface 9S toward the upstream side in the feed direction DF1.

The support plate 31 is located on the side of the surface of the feed tray main body 30 facing upward. The support plate 31 is supported by the feed tray main body 30 so as to be rotatable about an axis X31. The axis X31 extends in the width direction on the upstream end side of the support plate 31 in the feed direction DF1. The support plate 31 moves up and down as shown in FIGS. 1 and 3 by the operation of a lifter (elevating mechanism) 6 described later.

The sub-tray 30E is pulled out from the feed tray main body 30 and extends so as to be inclined upward toward the upstream side in the feed direction DF1.

The support surface 3A is constituted by a surface of the support plate 31 facing upward, a surface of the sub-tray 30E facing upward, and a surface of the feed tray main body 30 facing upward between the support plate 31 and the sub-tray 30E. A downstream end 3D of the support surface 3A in the feed direction DF1 is a downstream end of the support plate 31 in the feed direction DF1.

The image forming apparatus 1 includes a roller support member 29, a feed guide 89, and a frame 90, which are located forward of the image forming unit 2. The roller support member 29, the feed guide 89, and the frame 90 are resin molded members manufactured by injection molding of a thermoplastic resin and so on. The feed guide 89 and the frame 90 are located below the roller support member 29.

Figure 4:
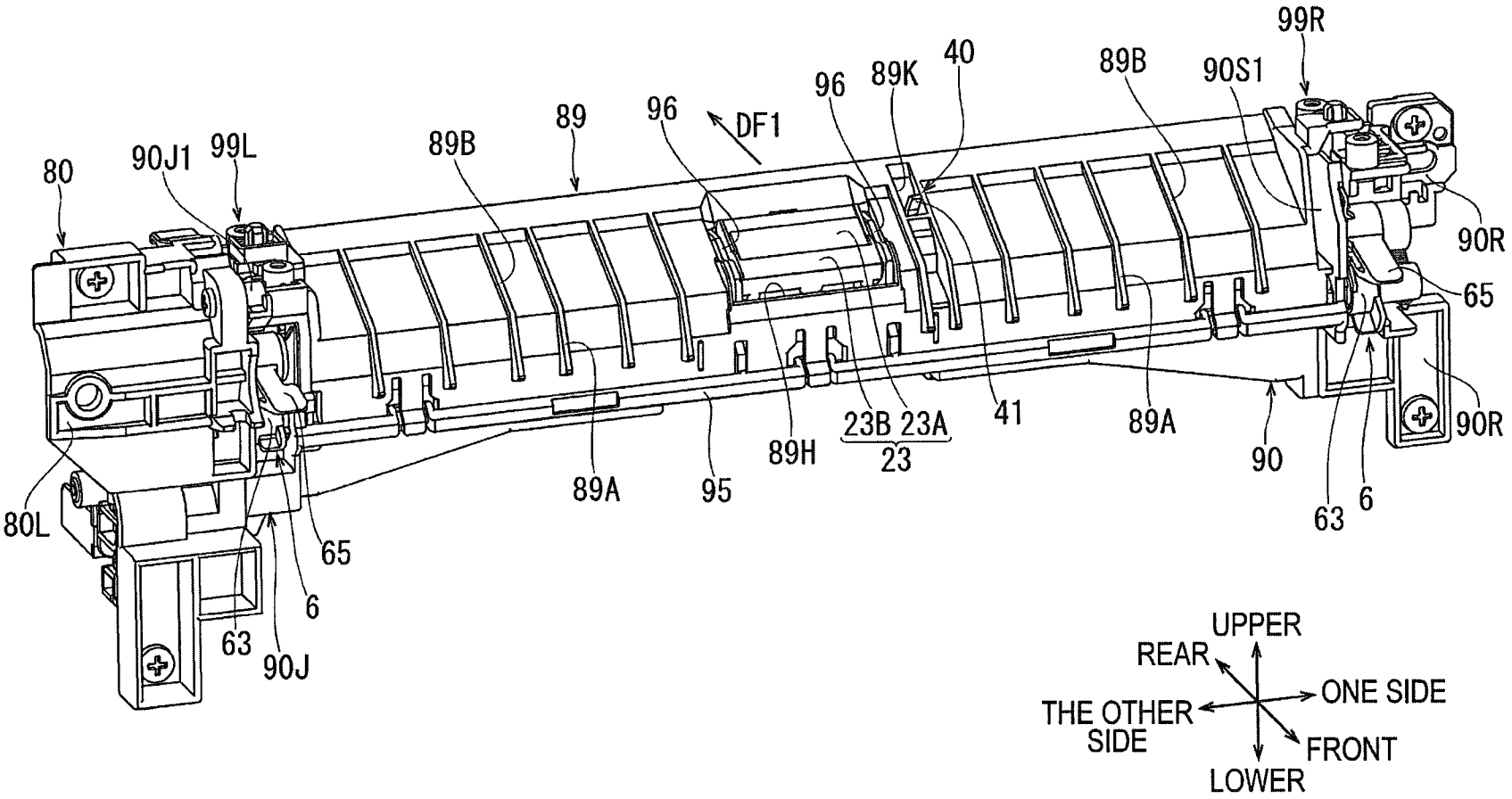
Figure 5:
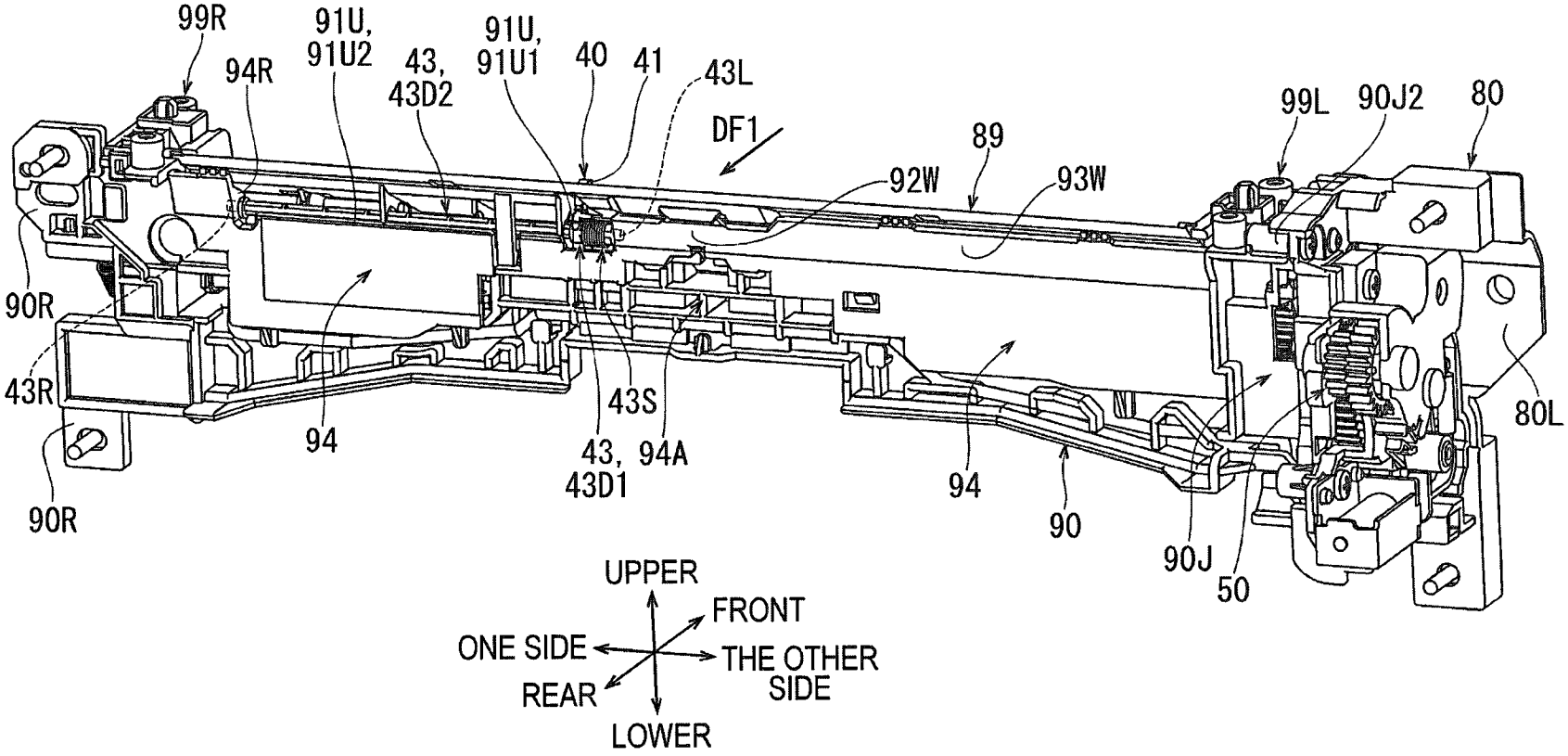

As shown in FIGS. 4 to 8, the frame 90 extends in the width direction. As shown in FIGS. 4 and 5, the feed guide 89 also extends in the width direction. The feed guide 89 is assembled to the frame 90 from above to cover an upper portion of the frame 90 and cover an upper side of a front portion of the frame 90.

The frame 90 has two side surfaces 90S1 and 90S2. The side surface 90S1 is a surface that is located on one side in the width direction of the frame 90 and faces the other side in the width direction. The side surface 90S2 is a surface that is located on the other side in the width direction of the frame 90 and faces one side in the width direction. The two side surfaces 90S1 and 90S2 and the upper surface of the feed guide 89 define a space through which the sheet SH passes.

As shown in FIG. 4, the frame 90 has connecting portions 99L and 99R at the upper end side of the portion located outside the two side surfaces 90S1 and 90S2 in the width direction.

Although not shown, the roller support member 29 also extends in the width direction. One end portion in the width direction of the roller support member 29 is connected to the connecting portion 99R, and an other end portion in the width direction of the roller support member 29 is connected to the connecting portion 99L.

Figure 8:
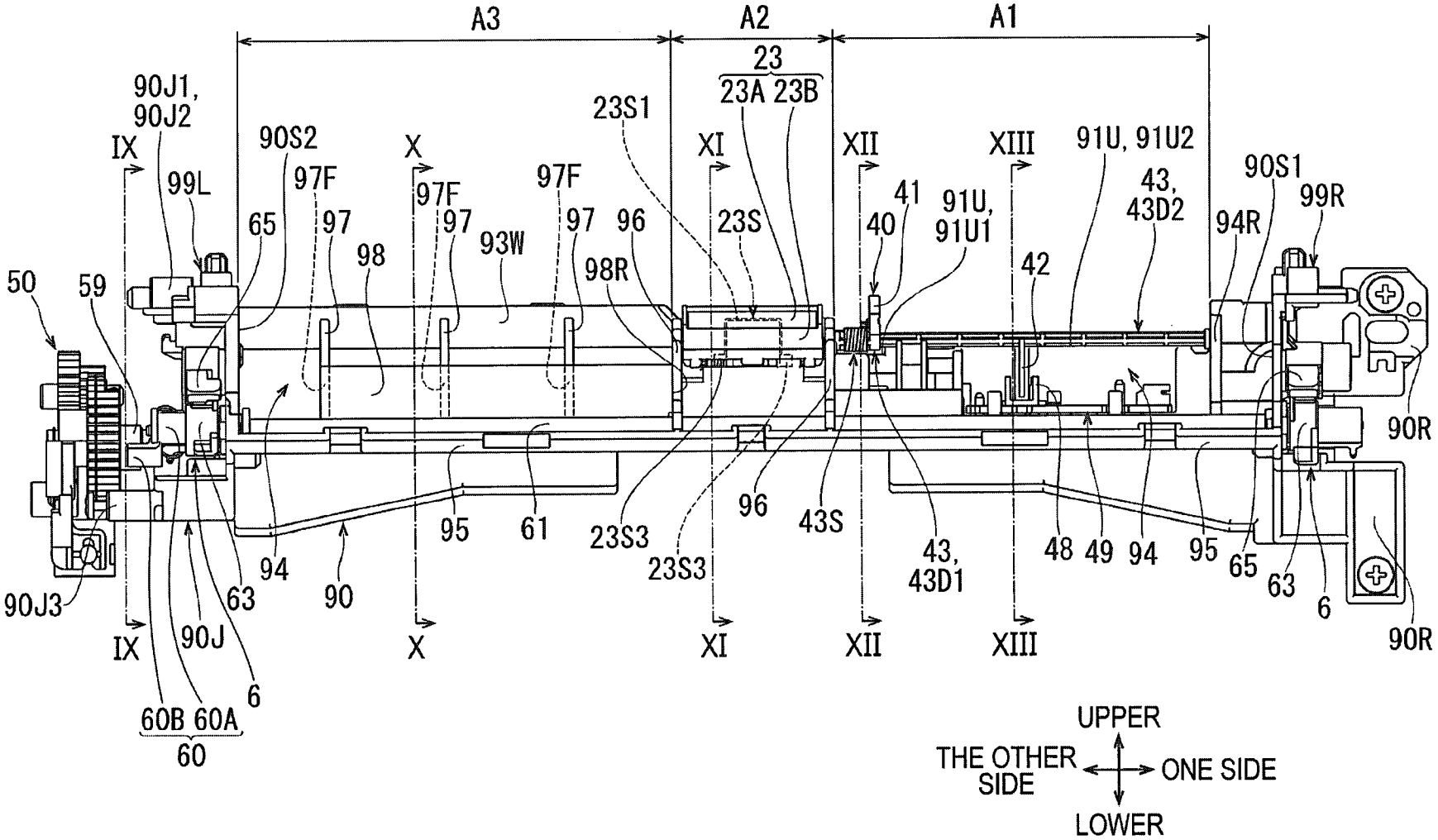
Figure 9:
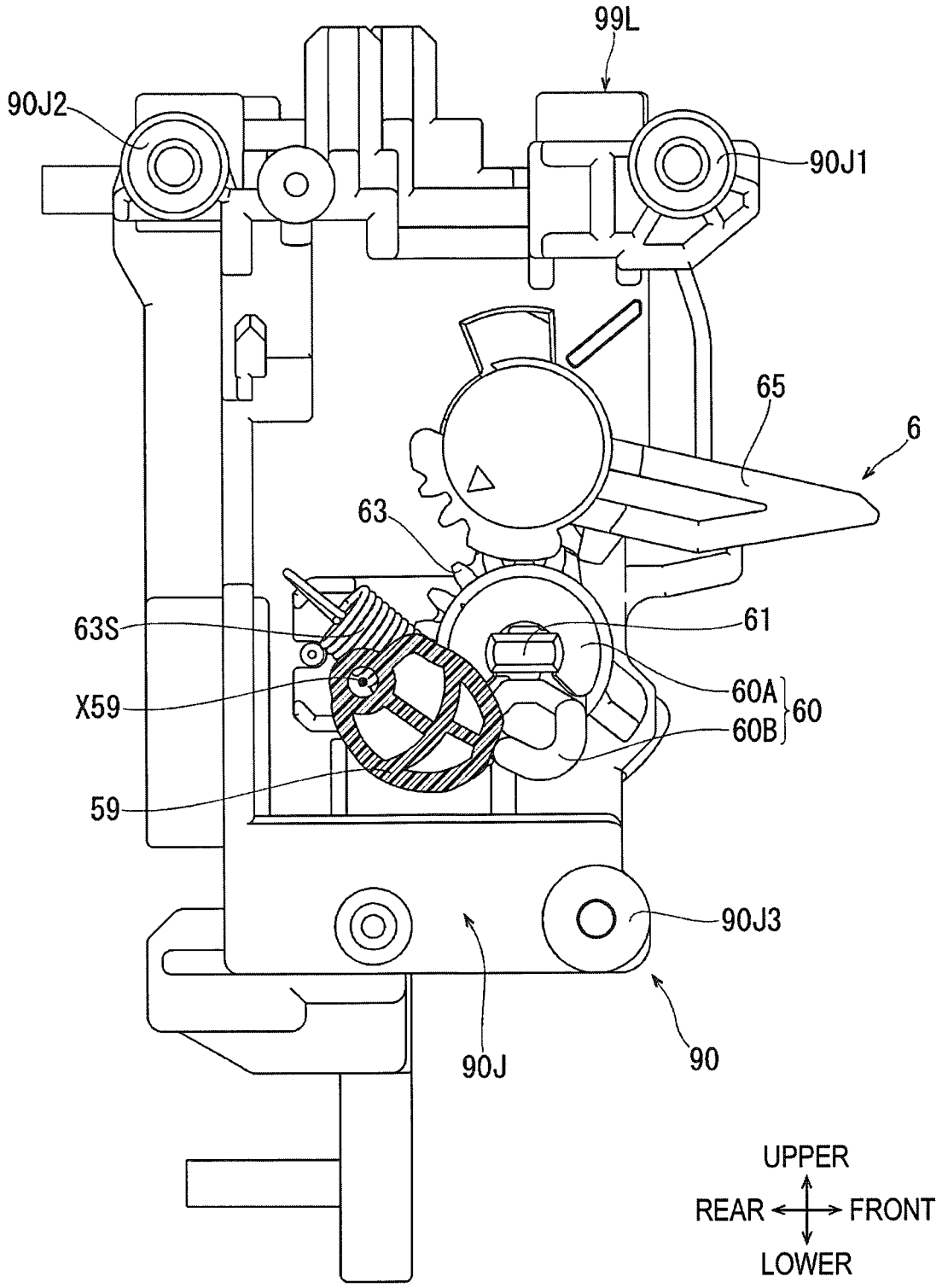
FIG. 9 is a cross-sectional view taken along line IX-IX in FIG. 8.

As shown in FIGS. 8 and 9, the frame 90 has a coupling end portion 90J. The coupling end portion 90J is an end portion of the frame 90 located on the other side in the width direction. The coupling end portion 90J is located on the other side in the width direction with respect to a separation pad 23 described later. The coupling end portion 90J includes a fastening boss 90J1 located at an upper front corner, a fastening boss 90J2 located at an upper rear corner, and a fastening boss 90J3 located at a lower front corner.

Each of the fastening bosses 90J1 to 90J3 protrudes in a cylindrical shape from the coupling end portion 90J toward the other side in the width direction, and a female screw is formed in the center portion.

Figure 6:
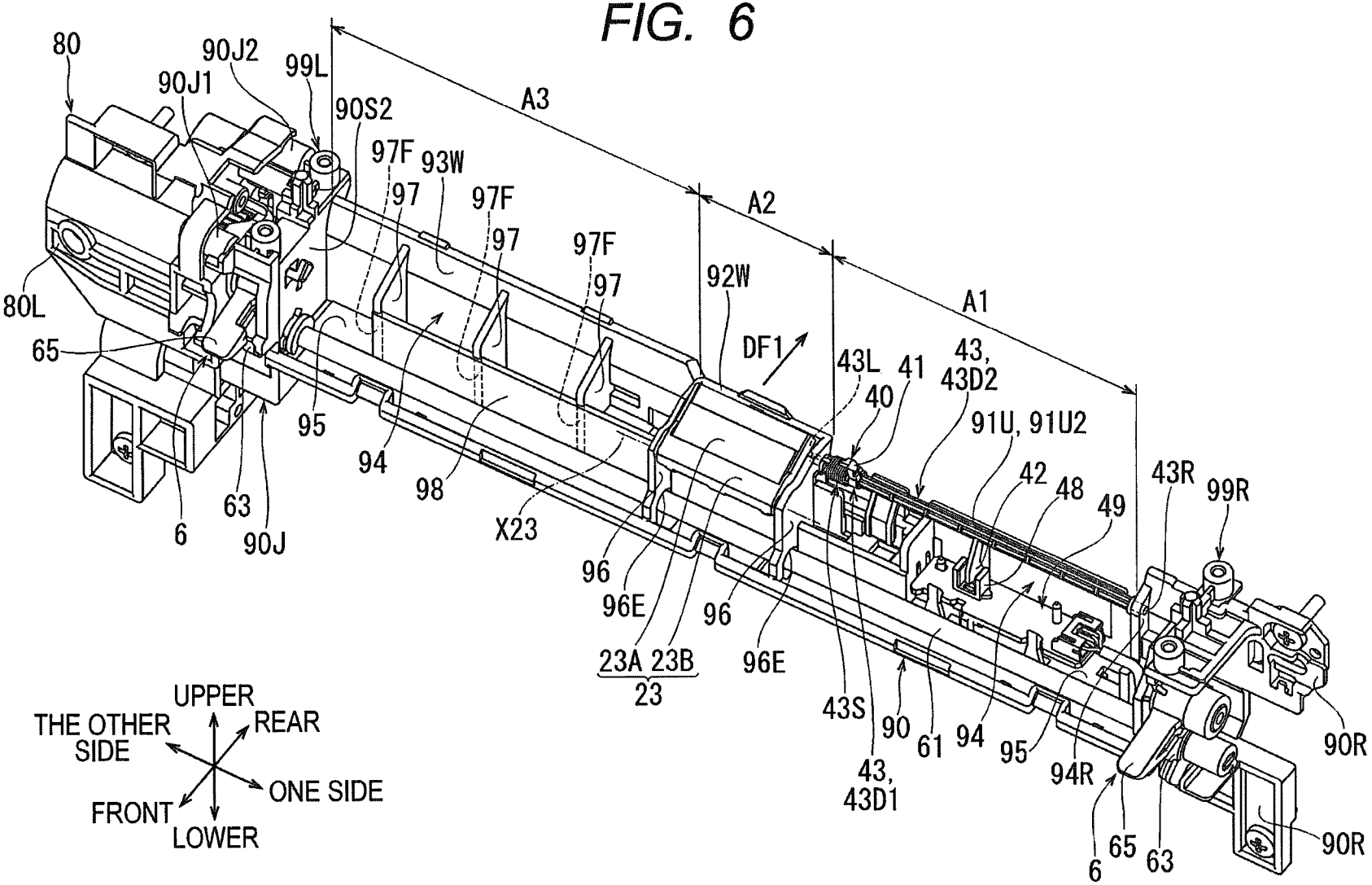

As shown in FIGS. 4 to 6, the image forming apparatus 1 includes a gear frame 80. The gear frame 80 is a resin molded member manufactured by injection molding of a thermoplastic resin and so on, similarly to the frame 90 and so on.

In a state where the gear frame 80 is located on the other side in the width direction with respect to the coupling end portion 90J of the frame 90, three male screws are inserted through the gear frame 80 and further screwed into the fastening bosses 90J1 to 90J3. In this way, the frame 90 is coupled to the gear frame 80 at the coupling end portion 90J.

One end portion 90R of the frame 90 located on one side in the width direction is coupled to a side frame (not shown) located on one side of the housing 9 in the width direction. Another end 80L of the gear frame 80 located on the other side in the width direction is coupled to another side frame (not shown) located on the other side of the housing 9 in the width direction. The frame 90 and the gear frame 80 serve reinforcing frames that extend in the width direction in a beam shape and are supported at both ends, and constitute a part of the internal frame of the housing 9.

As shown in FIGS. 5 and 10 to 13, the frame 90 includes a rear wall 94. The rear wall 94 extends in the width direction from the one end portion 90R of the frame 90 to the coupling end portion 90J, and extends in the upper-lower direction.

Figure 7:
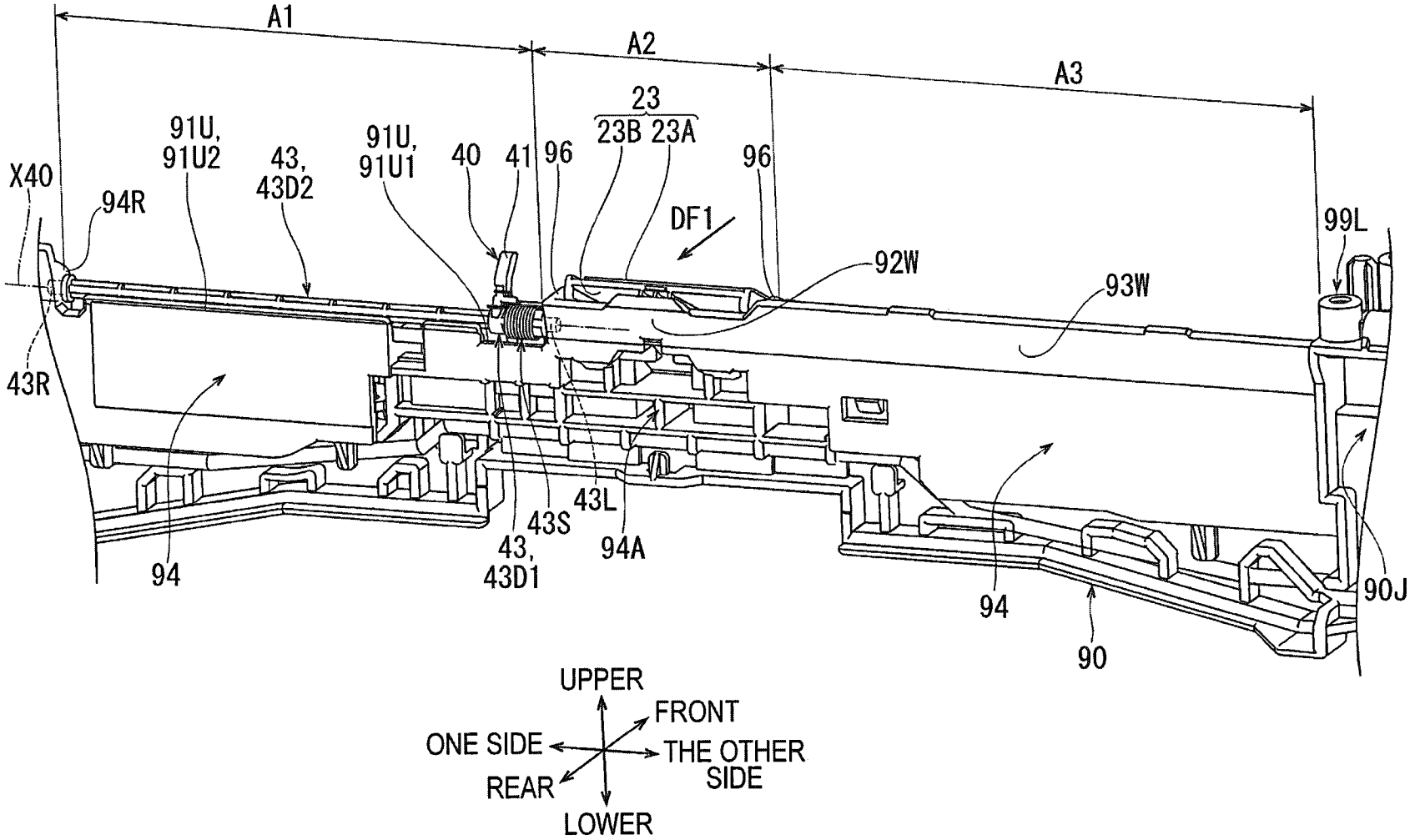
Figure 11:
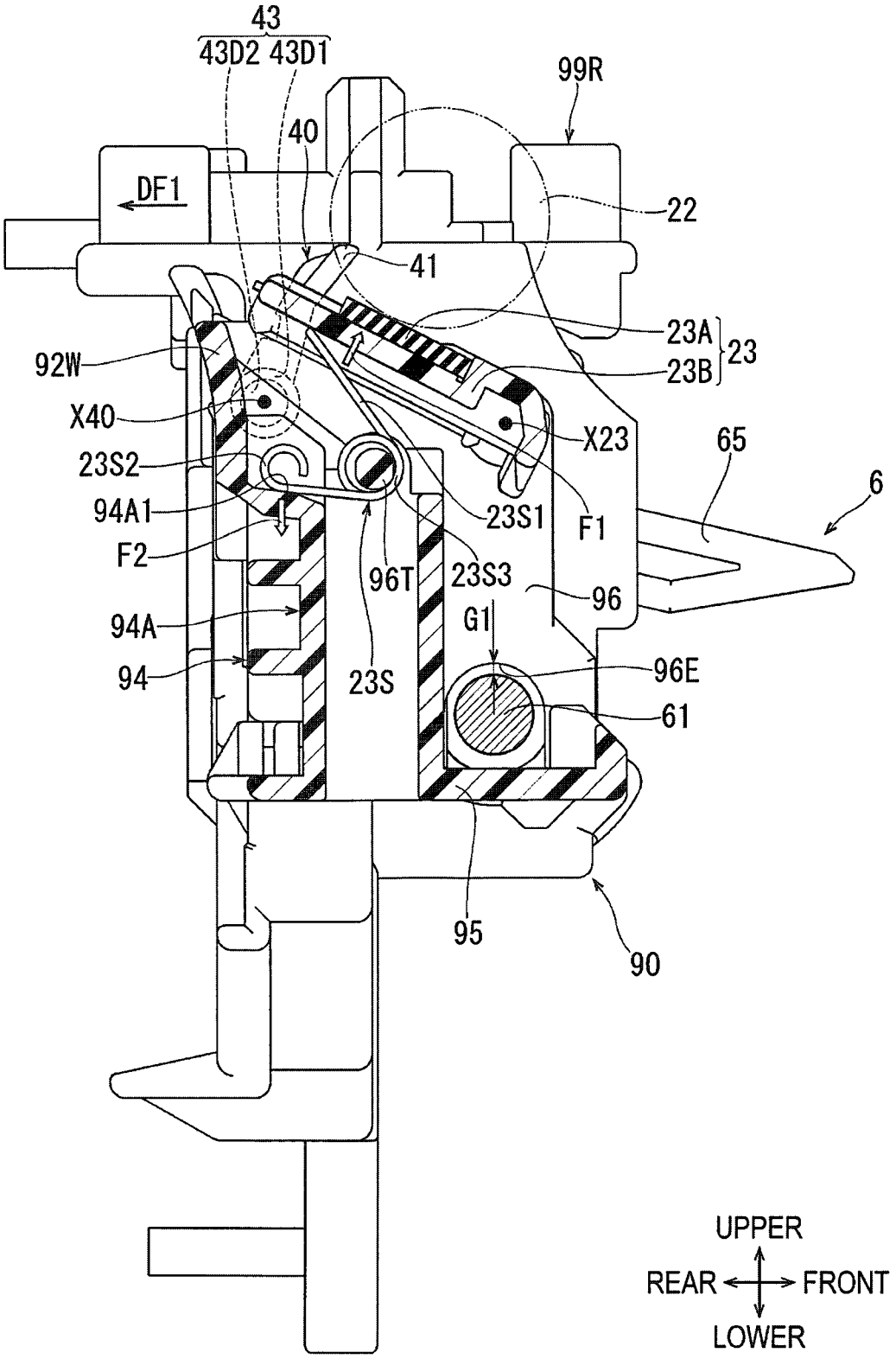
FIG. 11 is a cross-sectional view taken along the line XI-XI in FIG. 8.
Figure 12:
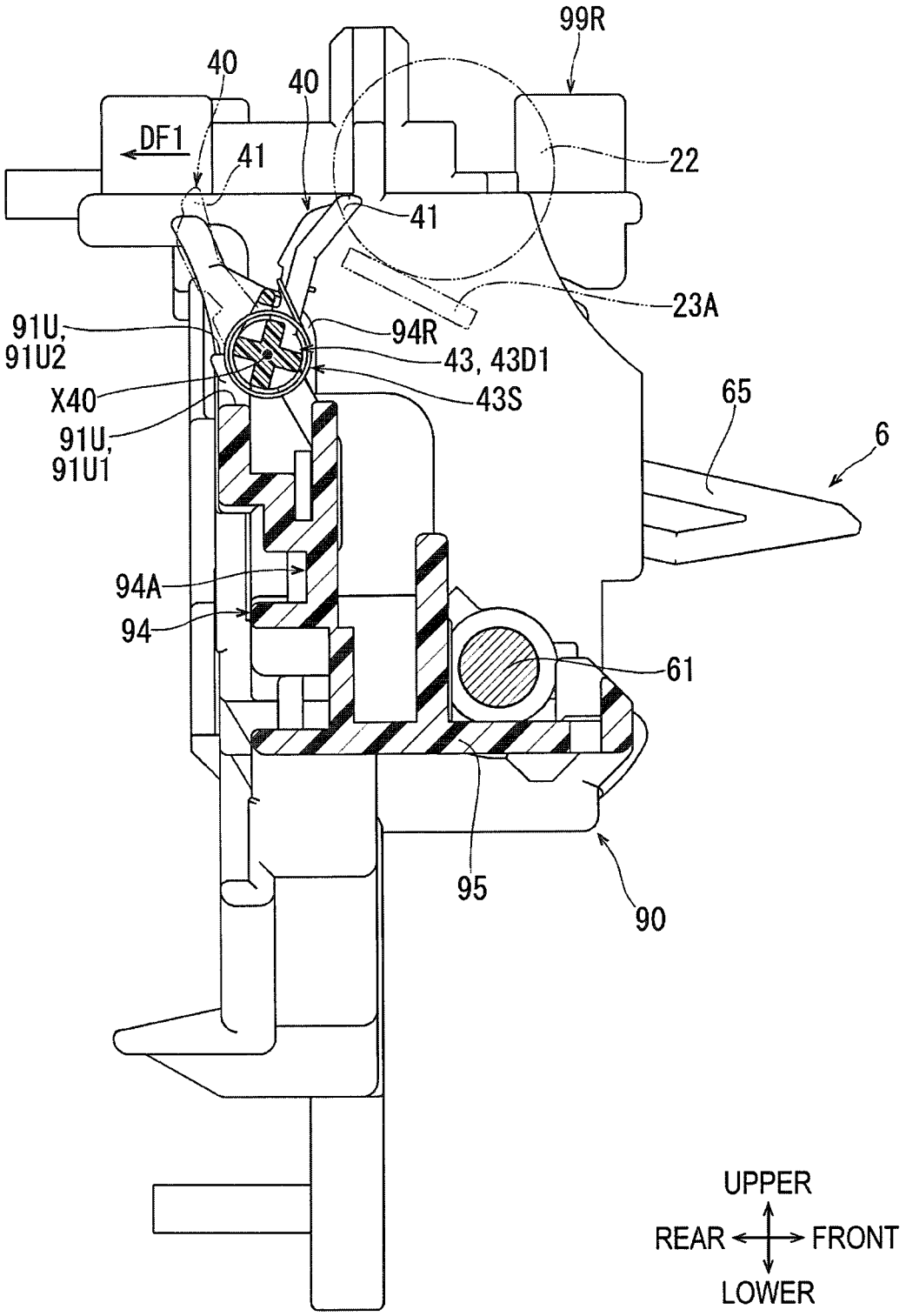
FIG. 12 is a cross-sectional view taken along line XII-XII in FIG. 8.

As shown in FIGS. 7, 11 and 12, the rear wall 94 has a reinforcement shape portion 94A. The reinforcement shape portion 94A is formed by recessing the widthwise center and its vicinity of the rear wall 94 forward, and forming a plurality of ribs extending in the upper-lower direction and a plurality of ribs extending in the width direction inside the recess. As shown in FIG. 7, the size of the upper end of the reinforcement shape portion 94A in the width direction is smaller than the size of the lower end of the reinforcement shape portion 94A in the width direction.

As shown in FIGS. 6 and 8, the frame 90 includes a base wall 95, two support walls 96, three reinforcement ribs (auxiliary ribs) 97, and reinforcement wall (auxiliary wall) 98.

As shown in FIGS. 10 to 13, the base wall 95 is located forward of the rear wall 94. A rear edge of the base wall 95 is connected to a lower edge of the rear wall 94. As shown in FIGS. 6 and 8, the base wall 95 extends in the width direction from the one end portion 90R of the frame 90 to the coupling end portion 90J, and extends in the front-rear direction.

The support walls 96 are located at the center of the rear wall 94 in the width direction and are separated from each other in the width direction. Each support wall 96 is located forward of the rear wall 94 and extends in the upper-lower direction and the front-rear direction.

As shown in FIG. 6, the rear edge of each support wall 96 is connected to the rear wall 94. The lower end of the front edge of each support wall 96 is connected to the front edge of the base wall 95. As shown in FIG. 4, the upper edge of each support wall 96 is adjacent to an inner peripheral edge of a rectangular hole 89H described later, and extends while being inclined upward toward the downstream side in the feed direction DF1.

Figure 10:
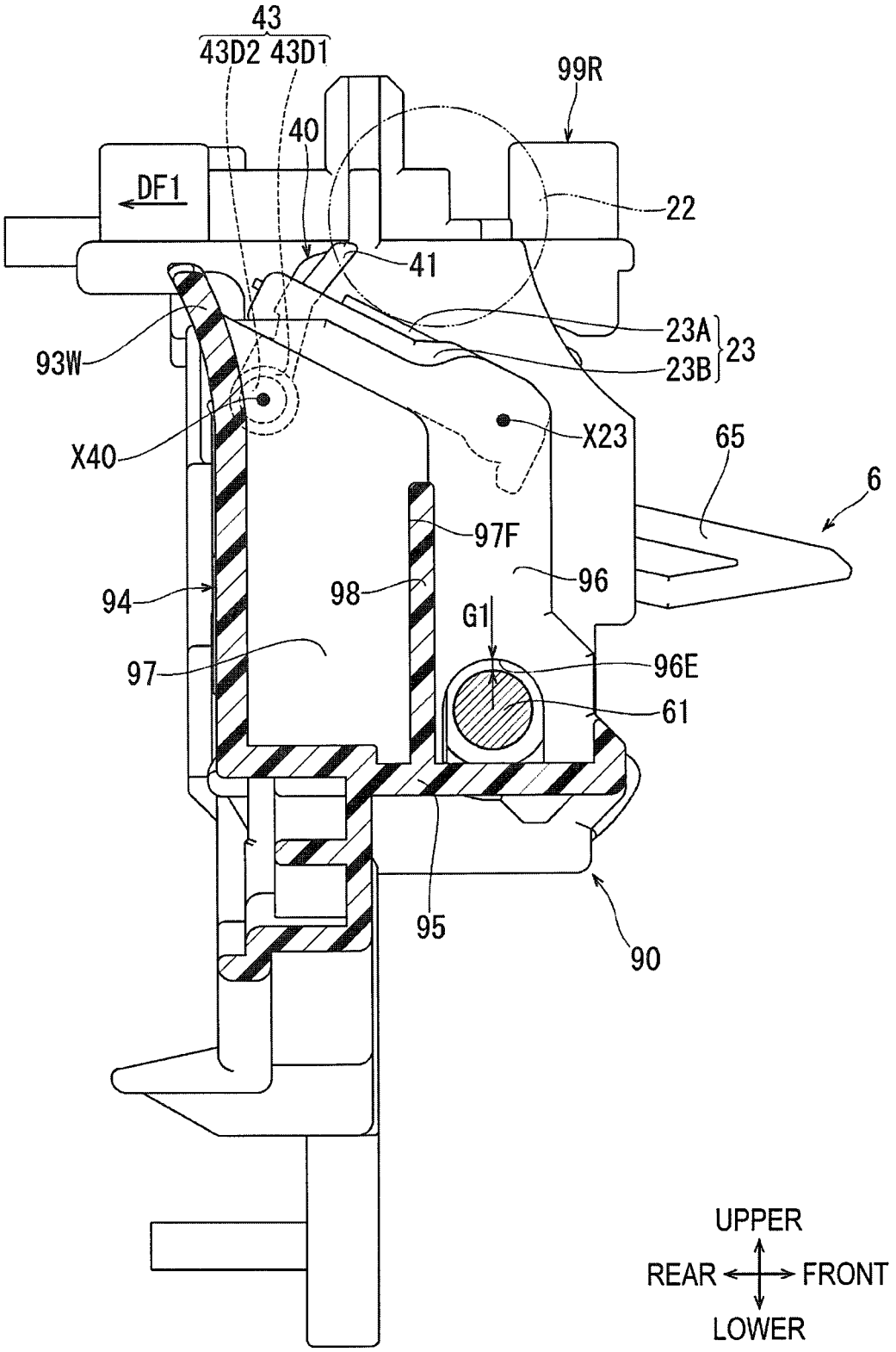
FIG. 10 is a cross-sectional view taken along line X-X in FIG. 8.

As shown in FIGS. 6 and 10, the reinforcement ribs 97 are located on the other side of the support walls 96 in the width direction and are spaced apart from each other in the width direction. Each reinforcement rib 97 is located forward of the rear wall 94 and extends in the upper-lower direction and the front-rear direction. The rear edge of each reinforcement rib 97 is connected to the rear wall 94.

The reinforcing wall 98 is connected to a front edge 97F which is an edge of each reinforcement rib 97 extending in the upper-lower direction at the upstream side in the feed direction DF1. The reinforcing wall 98 extends in the upper-lower direction and the width direction. The lower edge of the reinforcing wall 98 is connected to the base wall 95 at a position spaced rearward from the front edge of the base wall 95. As shown in FIG. 8, an edge 98R of the reinforcing wall 98 located on one side in the width direction is connected to the support wall 96 located on the other side in the width direction with respect to the separation pad 23 described later.

The image forming apparatus 1 includes a driving force transmission mechanism 50 shown in FIGS. 5 and 8, a drive cam 59 shown in FIGS. 8 and 9, and the lifter 6 shown in FIGS. 4, 6, and 8 to 13.

As shown in FIG. 5, the driving force transmission mechanism 50 has a well-known configuration and thus will be described only briefly, but includes a transmission gear set including a plurality of gears and an electromagnetic clutch including a solenoid. The driving force transmission mechanism 50 is assembled to the gear frame 80. The gear frame 80 rotatably supports each gear of the transmission gear set.

As shown in FIG. 8, the driving force transmission mechanism 50 is located on the other side in the width direction with respect to the coupling end portion 90J of the frame 90. The drive cam 59 is formed integrally with a gear located on the most downstream side in the driving force transmission direction in the transmission gear set of the driving force transmission mechanism 50. The drive cam 59 protrudes toward one side in the width direction toward the coupling end portion 90J.

As shown in FIG. 9, the drive cam 59 is an eccentric cam that rotates about an axis X59. That is, the gear frame 80 supports the drive cam 59 so as to be rotatable about the axis X59.

The driving force transmission mechanism 50 stops the drive cam 59 at a position shown in FIG. 9 when the image forming apparatus 1 is in a standby state. When the sheet SH supported on the support surface 3A of the feed tray 3 is fed toward the image forming unit 2, the driving force transmission mechanism 50 transmits a driving force from a driving motor (not shown) to the drive cam 59 at a particular timing, thereby rotating the drive cam 59 by approximately a half turn in a clockwise direction from the position shown in FIG. 9 and stops the drive cam 59.

Thereafter, when the image forming operation on the sheet SH supported on the support surface 3A is completed and the image forming apparatus 1 returns to the standby state, the driving force transmission mechanism 50 transmits a driving force from the driving motor (not shown) to the drive cam 59 at a particular timing, thereby further rotates the drive cam 59 by approximately a half turn in the clockwise direction in FIG. 9 and stops the drive cam 59 at the position shown in FIG. 9.

The lifter 6 includes a swing shaft 61 shown in FIGS. 6 and 8 to 13, a driven cam 60 shown in FIGS. 8 and 9, two swing gears 63 shown in FIGS. 4, 6, 8, and 9, and two arms 65 shown in FIGS. 4, 6, and 8 to 13.

As shown in FIG. 6, the swing shaft 61 is a metal cylinder. The swing shaft 61 is located at a position slightly above the base wall 95 and between the front edge of the base wall 95 and the reinforcing wall 98 in the front-rear direction, and extends in the width direction.

One end portion of the swing shaft 61 in the width direction is rotatably supported by the one end portion 90R of the frame 90. The other end portion of the swing shaft 61 in the width direction is rotatably supported by the coupling end portion 90J of the frame 90.

As shown in FIGS. 8 and 9, the driven cam 60 is fixed to the other end portion of the swing shaft 61 in the width direction. That is, the driven cam 60 is supported by the frame 90 at the coupling end portion 90J via the swing shaft 61.

As shown in FIG. 9, the swing shaft 61 is located forward of the axis X59 of the drive cam 59. The driven cam 60 includes a fixed portion 60A and a contact portion 60B. The fixed portion 60A is fixed to the swing shaft 61. The contact portion 60B protrudes from the fixed portion 60A toward the other side in the width direction at a position eccentric (shifted) downward from the swing shaft 61. The contact portion 60B is slidable on the outer peripheral surface of the drive cam 59.

As shown in FIG. 8, the swing gear 63 located on one side in the width direction is fixed to one end portion of the swing shaft 61 in the width direction. The swing gear 63 located on the other side in the width direction is fixed to an end portion of the swing shaft 61 located on the other side in the width direction in a state where the swing gear 63 is adjacent to the fixed portion 60A of the driven cam 60 from one side in the width direction. That is, the swing gears 63 are fixed to the swing shaft 61 at positions spaced apart from each other in the width direction.

As shown in FIG. 9, each of the swing gears 63 is a fan-shaped gear having gear teeth formed on an upper portion thereof. The swing gear 63 located on the other side in the width direction is urged by a tension coil spring 63S so as to rotate in the clockwise direction in FIG. 9. Although not shown, the swing gear 63 located on one side in the width direction is also urged by another tension coil spring 63S so as to rotate in the clockwise direction in FIG. 9. The contact portion 60B of the driven cam 60 is pressed against the outer peripheral surface of the drive cam 59 by the urging force of the tension coil spring 63S.

As shown in FIG. 8, the arm 65 located on one side in the width direction is swingably supported by the one end portion 90R of the frame 90 at a position above the swing gear 63 located at one side in the width direction. The arm 65 located on the other side in the width direction is swingably supported by the coupling end portion 90J of the frame 90 at a position above the swing gear 63 located on the other side in the width direction. That is, the arms 65 correspond to the swing gears 63 in a one-to-one manner. The frame 90 swingably supports the swing shaft 61 and the arms 65.

As shown in FIG. 9, each arm 65 has gear teeth that engage with the gear teeth of each swing gear 63, and has a portion extending forward beyond the gear teeth. The front end of each arm 65 is located forward of the frame 90.

As shown in FIG. 2, the support plate 31 has two receiving protrusions 31A. One receiving protrusion 31A protrudes outward in the width direction from a corner of the support plate 31 located downstream in the feed direction DF1 and on one side in the width direction. The other receiving protrusion 31A protrudes outward in the width direction from a corner of the support plate 31 located downstream in the feed direction DF1 and on the other side in the width direction.

Although not shown, the front end of each arm 65 contacts the corresponding receiving protrusion 31A of the support plate 31 from below. In this way, the arms 65 determine the position of the support plate 31 in the upper-lower direction.

In a state where the drive cam 59 is stopped at the position shown in FIG. 9, the arms 65 position the support plate 31 at the position shown in FIG. 1. When the drive cam 59 rotates clockwise from the position shown in FIG. 9 by approximately a half turn and stops at that position, the drive cam 59 transmits the driving force from the driving motor (not shown) to the driven cam 60.

Then, the driven cam 60 is urged by the tension coil spring 63S and swings in the clockwise direction in FIG. 9, together with the swing shaft 61 and the swing gears 63. The arms 65 swing in the counterclockwise direction in FIG. 9 by the driving force transmitted from the swing gears 63, and the front ends of the arms 65 lift the receiving protrusions 31A of the support plate 31. As a result, the arms 65 raise the support plate 31 to the position shown in FIG. 3, and brings the support plate 31 close to a feed roller 21 described later.

Thereafter, when the drive cam 59 further rotates approximately a half turn in the clockwise direction and stops at the position shown in FIG. 9, the drive cam 59 also transmits a driving force from the driving motor (not shown) to the driven cam 60.

Then, the driven cam 60 swings in the counterclockwise direction in FIG. 9 against the urging force of the tension coil spring 63S, together with the swing shaft 61 and the swing gears 63. Each arm 65 swings in the clockwise direction in FIG. 9 by the driving force transmitted from each swing gear 63, and the front end of each arm 65 descends while contacting the corresponding receiving protrusion 31A of the support plate 31 from below. As a result, each arm 65 lowers the support plate 31 to the position shown in FIG. 1, and separates the support plate 31 from the feed roller 21 described later.

That is, the lifter 6 moves the support plate 31 up and down to contact and separate from the feed roller 21 described later by transmitting a driving force from the driving motor (not shown) via the driving force transmission mechanism 50, the drive cam 59, and the driven cam 60.

As shown in FIGS. 10 and 11, each support wall 96 has a facing edge 96E on the lower end side thereof. The facing edge 96E is a part of the inner peripheral edge of a hole through which the swing shaft 61 passes, and extends in an arc shape along an upper portion of the outer peripheral surface of the swing shaft 61. The facing edge 96E faces the swing shaft 61 from above with a gap G1 between the facing edge 96E and the swing shaft 61.

The gap G1 between the swing shaft 61 and the facing edge 96E is sufficiently large so that the facing edge 96E does not contact the swing shaft 61. The gap G1 is, for example, approximately 2.0 mm (millimeters) to several mm.

As shown in FIG. 1, the image forming apparatus 1 includes the feed roller 21, a separation roller 22, the separation pad 23, and an urging spring 23S.

The roller support member 29 rotatably supports the feed roller 21 and the separation roller 22. The roller support member 29 supports the feed roller 21 and the separation roller 22 such that the positions of the rotation axes of the feed roller 21 and the separation roller 22 do not change. Lower portions of the feed roller 21 and the separation roller 22 are exposed below the roller support member 29.

The feed roller 21 is located above the support surface 3A and upstream, in the feed direction DF1, of the downstream end 3D of the support surface 3A in the feed direction DF1. The separation roller 22 is located downstream of the downstream end 3D of the support surface 3A in the feed direction DF1.

As shown in FIG. 4, the feed guide 89 has a regulating surface 89A and a feeding surface 89B. The regulating surface 89A is a surface facing forward and extending in the width direction. The regulating surface 89A is inclined such that the upper end thereof is located rearward of the lower end thereof. The feeding surface 89B is a surface facing upward and connected to the upper end of the regulating surface 89A. The feeding surface 89B extends while being inclined upward toward the downstream side in the feed direction DF1. The rectangular hole 89H for exposing the separation pad 23 is formed at the center of the feeding surface 89B in the width direction.

As shown in FIG. 1, the regulating surface 89A faces the downstream end 3D of the support surface 3A from the downstream side in the feed direction DF1. In a state where the support plate 31 is lowered, the regulating surface 89A contacts and stops a downstream end of the sheet SH in the feed direction DF1 which is supported by the support surface 3A.

As shown in FIG. 4, the separation pad 23 includes a friction member 23A, which is a rubber sheet and so on, and a friction member holding portion 23B, which is a resin-molded product. The friction member 23A is affixed to an upper surface of the friction member holding portion 23B. The separation pad 23 is exposed from the rectangular hole 89H of the feeding surface 89B.

As shown in FIGS. 6, 10 and 11, in the frame 90, the two support walls 96 sandwich the separation pad 23 from the outer sides in the width direction and support the friction member holding portion 23B of the separation pad 23 so as to be rotatable about an axis X23. The axis X23 extends in the width direction on the upstream end side of the friction member holding portion 23B in the feed direction DF1.

In this way, the frame 90 supports the separation pad 23 so that the separation pad 23 contacts and separates from the separation roller 22. As shown in FIG. 11, the friction member 23A of the separation pad 23 is located directly below the separation roller 22 and faces the separation roller 22.

As shown in FIG. 8, the urging spring 23S is located inward of the two support walls 96 of the frame 90 in the width direction. That is, the urging spring 23S is disposed between the two support walls 96 of the frame 90. As shown in FIG. 11, the urging spring 23S is formed by bending a single metallic wire material. The urging spring 23S includes a pair of coil portions 23S3, a first extension portion 23S1, and a pair of second extension portions 23S2.

In FIG. 11, the coil portion 23S3 and the second extension portion 23S2 located on one side in the width direction are located on the back side of the paper surface and overlap the coil portion 23S3 and the second extension portion 23S2 located on the other side in the width direction, and thus are not shown.

As shown in FIG. 8, the coil portions 23S3 are separated from each other in the width direction. As shown in FIG. 11, each coil portion 23S3 is supported by the frame 90 by being fitted onto a protruding portion 96T that protrudes inward in the width direction from each support wall 96 of the frame 90.

As shown in FIG. 8, the first extension portion 23S1 is bent into a substantially "U" shape, and two end portions thereof are connected to the coil portions 23S3 on the inner side in the width direction. As shown in FIG. 11, the portion of the first extension portion 23S1 that is farthest from each coil portion 23S3 contacts the lower surface of the friction member holding portion 23B of the separation pad 23 from below.

Each second extension portion 23S2 is connected to each coil portion 23S3 at the outer side in the width direction and extends rearward. The rear end of each second extension portion 23S2 contacts an upper end surface 94A1 of the reinforcement shape portion 94A of the frame 90 from above. The upper end surface 94A1 of the reinforcement shape portion 94A is an upper end surface of a wall that forms a part of the recess of the reinforcement shape portion 94A, the wall extending in the width direction and the front-rear direction. The upper end surface 94A1 is located at the upper end of the reinforcement shape portion 94A.

That is, the urging spring 23S is located between the frame 90 and the friction member holding portion 23B of the separation pad 23. The urging spring 23S exerts an urging force F1 that presses the separation pad 23 toward the separation roller 22. The urging spring 23S urges the friction member holding portion 23B which contacts the first extension portion 23S1 by the urging force F1.

The frame 90 receives a downward reaction force F2 which is a reaction force of the urging force F1. The urging spring 23S urges the reinforcement shape portion 94A of the frame 90, which contacts the rear ends of the two second extension portions 23S2, with the reaction force F2.

As shown in FIG. 3, the lifter 6 is operated to lift the support plate 31, and the feed roller 21 contacts the uppermost sheet SH supported on the support surface 3A. The feed roller 21 rotates in this state to feed the uppermost sheet SH toward the separation roller 22, that is, in the feed direction DF1. The feeding surface 89B guides the sheet SH fed by the feed roller 21.

The separation roller 22 takes over the sheet SH fed by the feed roller 21 and feeds the sheet SH in the feed direction DF1. At this time, the separation roller 22 and the separation pad 23 separate the sheets SH one sheet at a time when the sheets SH to be fed are plural. When a state where the sheet SH is not present and the separation pad 23 contacts the separation roller 22 and the separation pad 23 and the friction member holding portion 23B are stationary changes to a state where the sheet SH is conveyed by the separation roller 22, the friction member 23A and the friction member holding portion 23B are lowered against the urging spring 23S by the amount of thickness of the sheet SH. The image forming unit 2 forms an image on the sheet SH. Thereafter, a conveyor (not shown) conveys the sheet SH on which the image is formed and discharges the sheet SH to the discharge tray 9T. When the image forming operation is finished, as shown in FIG. 1, the lifter 6 is operated to lower the support plate 31.

As shown in FIGS. 4 to 8 and 10 to 13, the image forming apparatus 1 includes an actuator 40. The actuator 40 is configured to detect the sheet SH that is separated one sheet at a time by the separation roller 22 and the separation pad 23 and fed toward the image forming unit 2.

As shown in FIG. 6, the actuator 40 is one member integrally including a contact piece 41, a rotation shaft 43, and a shutter 42. The actuator 40 is a resin-molded product manufactured by injection molding of a thermoplastic resin and so on.

As shown in FIG. 5, the rotation shaft 43 extends in the width direction at a position below the downstream end of the feeding surface 89B of the feed guide 89 in the feed direction DF1.

As shown in FIGS. 6 and 7, a support rib 94R is formed in the vicinity of the one end portion 90R of the frame 90. The support rib 94R protrudes forward from the rear wall 94 and extends in the upper-lower direction. One end 43R of the rotation shaft 43 in the width direction is inserted into a shaft hole formed in an upper end portion of the support rib 94R, and is rotatably supported by the support rib 94R.

An other end 43L of the rotation shaft 43 in the width direction is inserted into a shaft hole formed in an upper-rear corner portion of the support wall 96 located on one side in the width direction, and is rotatably supported by the support wall 96.

That is, the frame 90 rotatably supports the one end 43R and the other end 43L of the rotation shaft 43 in the width direction. The rotation shaft 43 is located on one side of the separation pad 23 in the width direction. The contact piece 41 and the shutter 42, which are integral with the rotation shaft 43, are also located on one side of the separation pad 23 in the width direction.

A first region A1, a second central region A2, and a second side region A3 are set as follows between the side surface 90S1 and the side surface 90S2 that define the space through which the sheet SH passes in the width direction. A region of the frame 90 located between the one end 43R and the other end 43L of the rotation shaft 43 in the width direction is referred to as the first region A1. A region of the frame 90 in which the separation pad 23 and the two support walls 96 supporting the separation pad 23 are located in the width direction is referred to as the second central region A2. A region of the frame 90 located on the other side in the width direction with respect to the support wall 96 located on the other side in the width direction is referred to as the second side region A3. The second central region A2 and the second side region A3 are an example of "second region" of the present disclosure.

The coupling end portion 90J is located on the other side in the width direction of the second side region A3.

As shown in FIG. 7, the rotation shaft 43 rotates about a rotation axis X40 extending in the width direction. The rotation shaft 43 includes a large-diameter portion 43D1 and a small-diameter portion 43D2.

The large-diameter portion 43D1 is located on one side in the width direction with respect to the other end 43L of the rotation shaft 43 in the width direction, and has a larger diameter than the other end 43L. The large-diameter portion 43D1 is adjacent to the support wall 96 located on one side in the width direction.

Figure 13:
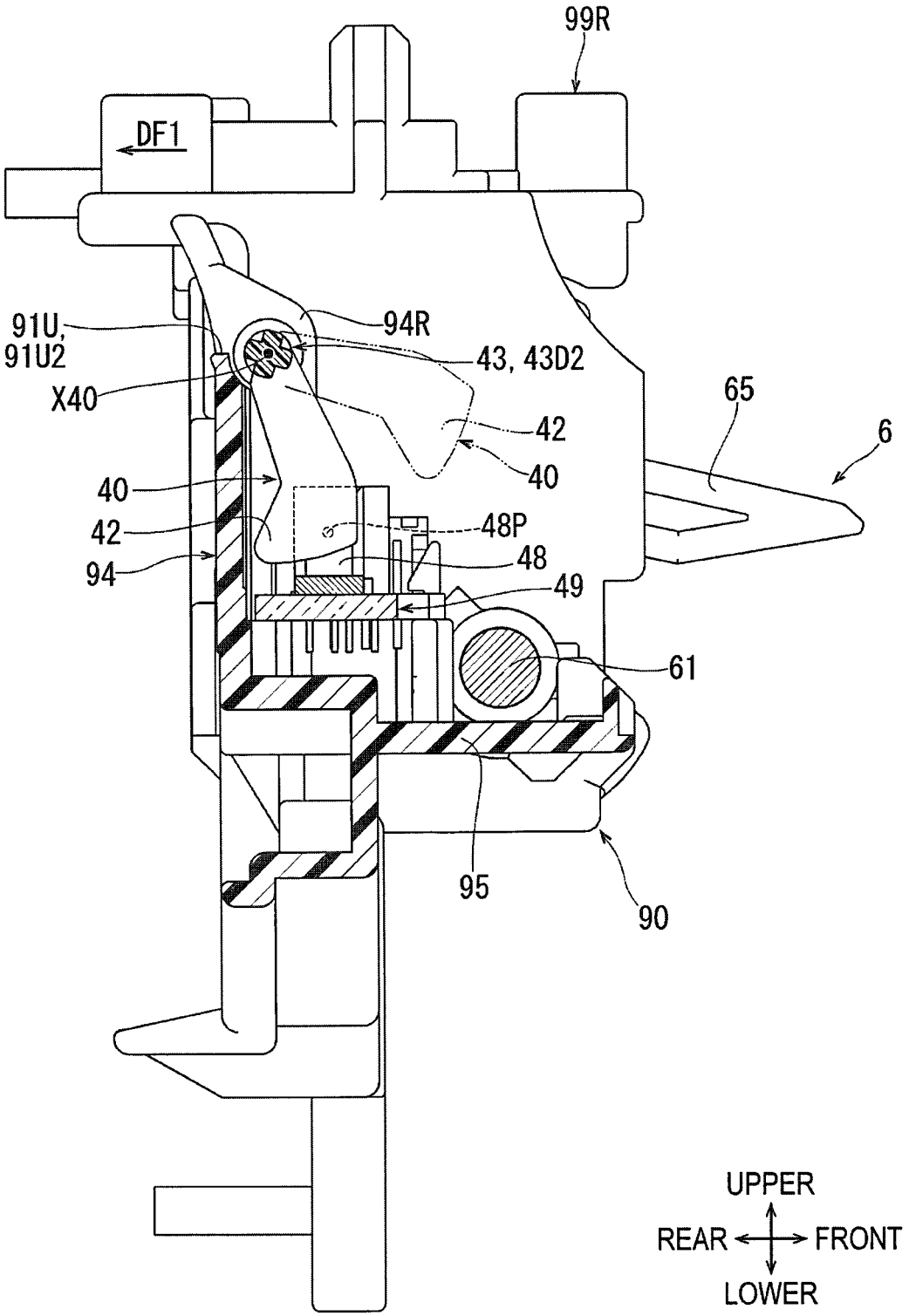
FIG. 13 is a cross-sectional view taken along line XIII-XIII in FIG. 8.

The small-diameter portion 43D2 is located on one side in the width direction with respect to the large-diameter portion 43D1, and extends to the one end 43R of the rotation shaft 43 in the width direction. The small-diameter portion 43D2 is significantly longer than the large-diameter portion 43D1 in the width direction. As shown in FIGS. 12 and 13, the small-diameter portion 43D2 has a smaller diameter than the large-diameter portion 43D1.

As shown in FIGS. 7 and 12, the contact piece 41 is connected to the large-diameter portion 43D1, and protrudes radially outward of the rotation axis X40, that is, in an upward and slightly forward direction. As shown in FIG. 4, the feed guide 89 has an insertion hole 89K which is opened at a position shifted from the rectangular hole 89H to one side in the width direction and to the downstream side in the feed direction DF1. The contact piece 41 passes through the insertion hole 89K and protrudes farther upward than the feeding surface 89B.

As shown in FIGS. 7 and 12, the coil portion of the torsion coil spring 43S is externally fitted to the large-diameter portion 43D1. One end of the torsion coil spring 43S is engaged with the contact piece 41. Although not shown, the other end of the torsion coil spring 43S is engaged with the frame 90. The torsion coil spring 43S urges the contact piece 41 to rotate forward about the rotation axis X40.

The contact piece 41 is held at a position indicated by a solid line in FIG. 12 by the urging force of the torsion coil spring 43S. In this state, the contact piece 41 is located at a position slightly shifted downstream in the feed direction DF1 from a nip position between the separation roller 22 and the friction member 23A of the separation pad 23.

As shown in FIGS. 6 and 13, the shutter 42 is connected to the rotation shaft 43 at an intermediate portion of the small-diameter portion 43D2 in the width direction, that is, in the first region A1. The shutter 42 protrudes downward and slightly forward in a radially outward direction of the rotation axis X40.

In a state where the contact piece 41 is located at a position indicated by a solid line in FIG. 12, the shutter 42 is located at a position indicated by a solid line in FIG. 13.

The contact piece 41 contacts the leading edge of the sheet SH passing through the nip position between the separation roller 22 and the friction member 23A of the separation pad 23, and rotates together with the rotation shaft 43 and the shutter 42 about the rotation axis X40, and falls rearward as shown by a two-dot chain line in FIG. 12. Due to this, the shutter 42 moves forward and upward as shown by a two-dot chain line in FIG. 13.

As shown in FIGS. 6, 8, and 13, the image forming apparatus 1 includes a sensor board (sensor circuit board) 49. The sensor board 49 is assembled to the upper surface side of the base wall 95 in the first region A1. The frame 90 supports the sensor board 49 by a positioning pin, a locking piece, and so on which protrude upward from the base wall 95.

The sensor board 49 includes a photosensor 48. As shown in FIG. 13, the photosensor 48 has an optical path 48P along which light emitted from a light emitting portion reaches a light receiving portion.

The photosensor 48 detects that the shutter 42 is at the position indicated by the solid line in FIG. 13 when the optical path 48P is blocked. The photosensor 48 detects that the shutter 42 has rotated to the position indicated by the two-dot chain line in FIG. 13 when the optical path 48P is opened. The detection result of the photosensor 48 is transmitted to a controller (not shown) and used for controlling the operation timing of the image forming unit 2 and so on.

As shown in FIG. 7, an upper edge 91U of the frame 90 in the first region A1 is the upper edge of the rear wall 94 in the first region A1. The upper edge 91U includes an upper edge 91U1 and an upper edge 91U2.

The upper edge 91U (91U1) of the frame 90 in the first region A1 is in a range facing the large-diameter portion 43D1. The upper edge 91U (91U2) of the frame 90 in the first region A1 is in a range facing the small-diameter portion 43D2.

As shown in FIGS. 12 and 13, the height of the upper edge 91U of the frame 90 in the first region A1 is at the same height or below the height of the rotation axis X40.

More specifically, as shown in FIG. 12, the upper edge 91U (91U1) of the frame 90 in the first region A1 is located below the large-diameter portion 43D1 and the coil portion of the torsion coil spring 43S in the range facing the large-diameter portion 43D1. In the front-rear direction, a part of the front side of the upper edge 91U (91U1) and a part of the rear side of the large-diameter portion 43D1 overlap each other.

As shown in FIG. 13, the upper edge 91U (91U2) of the frame 90 in the first region A1 is located above the lower end of the small-diameter portion 43D2 in the range facing the small-diameter portion 43D2, and the height of the upper edge 91U (91U2) is at the same height or below the rotation axis X40. The thickness in the feed direction DF1 of the upper edge 91U (91U2) in the first region A1 of the frame 90 is smaller than the thickness in the feed direction DF1 of a portion of the rear wall 94 which is located below the lower end of the small-diameter portion 43D2. That is, the upper edge 91U (91U2) of the frame 90 in the first region A1 is formed to be thin in the feed direction DF1 so as to avoid the small-diameter portion 43D2.

As shown in FIG. 7, the frame 90 includes standing walls 92W and 93W in the second central region A2 and the second side region A3. The standing wall 92W is connected to a portion of the rear wall 94 located in the second central region A2 and extends upward. The standing wall 93W is connected to a portion of the rear wall 94 located in the second side region A3 and extends upward.

The standing walls 92W and 93W extend farther upward than the upper edge 91U of the frame 90 in the first region A1, and extend in the width direction. The standing wall 92W and the standing wall 93W are continuous in the width direction.

As shown in FIG. 11, the standing wall 92W is located rearward of the upper end surface 94A1 of the reinforcement shape portion 94A. The standing wall 92W extends farther upward than the rotation shaft 43. The standing wall 92W has a portion overlapping the large-diameter portion 43D1 and the small-diameter portion 43D2 of the rotation shaft 43 when viewed along the width direction.

As shown in FIG. 10, the standing wall 93W overlaps the standing wall 92W when viewed along the width direction. The standing wall 93W extends farther upward than the rotation shaft 43, and extends farther upward than the standing wall 92W. The upper end of the standing wall 93W is located above the friction member 23A of the separation pad 23. The standing wall 93W has a portion overlapping the large-diameter portion 43D1 and the small-diameter portion 43D2 of the rotation shaft 43 when viewed along the width direction.

The standing walls 92W and 93W extend upward while the thickness in the feed direction DF1 is constant. The standing walls 92W and 93W are slightly curved toward the downstream side in the feed direction DF1 above the rotation axis X40.

As shown in FIGS. 6 and 10, each reinforcement rib 97 is located upstream of the standing wall 93W in the feed direction DF1. The upper end side of each reinforcement rib 97 is connected to the standing wall 93W.

In the image forming apparatus 1 of the embodiment, as shown in FIGS. 12 and 13, in the frame 90, the height of the upper edge 91U in the first region A1, that is, the height of the upper edge of the rear wall 94 in the first region A1 is at the same height or below the rotation axis X40. That is, the frame 90 is configured such that the height of the upper edge 91U in the first region A1 is lowered and the thickness of the upper edge 91U in the first region A1 is reduced, so as not to interfere with the operation range of the contact piece 41 and the rotation shaft 43 of the actuator 40.

As shown in FIGS. 7, 10, and 11, in the second central region A2 and the second side region A3, the frame 90 includes the standing walls 92W and 93W extending farther upward than the upper edge 91U in the first region A1. That is, in the frame 90, the standing walls 92W and 93W are provided in the second central region A2 and the second side region A3 which are outside the operation range of the contact piece 41 and the rotation shaft 43 of the actuator 40. Thus, the standing walls 92W and 93W do not interfere with the operation range of the contact piece 41 and the rotation shaft 43 regardless of the position of the standing walls 92W and 93W in the feed direction DF1.

Thus, in the image forming apparatus 1, the standing walls 92W and 93W reinforce the frame 90, and thus the rigidity of the frame 90 is increased so as to resist the reaction force F2 of the urging force F1 shown in FIG. 11. As a result, the frame 90 is less likely to be bent downward, and thus, for example, a problem such as a decrease in the separation performance of the separation roller 22 and the separation pad 23 is less likely to occur.

Thus, according to the image forming apparatus 1 of the embodiment, the rigidity of the frame 90 that supports the separation pad 23 and the rotation shaft 43 of the actuator 40 is increased, and an increase in size in the feed direction DF1 is suppressed.

In the image forming apparatus 1, as shown in FIGS. 10 and 11, the standing walls 92W and 93W extend farther upward than the rotation shaft 43. With this configuration, the standing walls 92W and 93W reinforces the frame 90 with high reliability.

In the image forming apparatus 1, as shown in FIGS. 10 and 11, the standing walls 92W and 93W have portions overlapping the large-diameter portion 43D1 and the small-diameter portion 43D2 of the rotation shaft 43 when viewed along the width direction. This configuration further suppresses an increase in size in the feed direction DF1.

In the image forming apparatus 1, as shown in FIG. 7, the rotation shaft 43 includes the large-diameter portion 43D1 and the small-diameter portion 43D2. As shown in FIG. 12, the upper edge 91U (91U1) of the frame 90 in the first region A1 is located below the large-diameter portion 43D1 in the range facing the large-diameter portion 43D1. As shown in FIG. 13, the upper edge 91U (91U2) of the frame 90 in the first region A1 is located above the lower end of the small-diameter portion 43D2 in the range facing the small-diameter portion 43D2. With this configuration, in the upper edge 91U (91U1, 91U2) of the frame 90 in the first region A1, the upper edge 91U (91U1) in the range facing the large-diameter portion 43D1 is formed to be recessed downward, and thus the rigidity of the frame 90 is further increased, compared with a case where the height of the entire upper edge 91U is lowered.

In the image forming apparatus 1, as shown in FIG. 5, the frame 90 is coupled to the gear frame 80 at the coupling end portion 90J located on the other side of the separation pad 23 in the width direction. As shown in FIGS. 8 and 9, the driven cam 60 is supported by the frame 90 at the coupling end portion 90J via the swing shaft 61. With this configuration, the gear frame 80 and the coupling end portion 90J having increased rigidity by being reinforced by the standing walls 92W and 93W of the frame 90 are coupled to each other to reinforce each other. As a result, the relative positional relationship between the drive cam 59 supported by the gear frame 80 and the driven cam 60 supported by the coupling end portion 90J is less likely to be deviated, which suppresses variation in the stroke when the support plate 31 moves up and down.

In the image forming apparatus 1, as shown in FIGS. 8 and 9, the frame 90 supports the swing shaft 61 and the arms 65 so as to be swingable. With this configuration, the swing gears 63 fixed to the swing shaft 61 and the arms 65 corresponding to the swing gears 63 in a one to-one manner are supported by the same frame 90, and thus the engagement between each swing gear 63 and the corresponding arm 65 is unlikely to be deviated. As a result, the image forming apparatus 1 smoothly transmits the driving force from each swing gear 63 to the corresponding arm 65.

In the image forming apparatus 1, as shown in FIGS. 10 and 11, each support wall 96 has, at the lower end side, the facing edge 96E facing the swing shaft 61 from above with the gap G1 between the facing edge 96E and the swing shaft 61. The gap G1 is sufficiently large so that the facing edge 96E does not contact the swing shaft 61. With this configuration, the support wall 96 having the facing edge 96E does not hinder the swing of the swing shaft 61.

In the image forming apparatus 1, as shown in FIG. 6, the upper end side of each reinforcement rib 97 of the frame 90 is connected to the standing wall 93W. With this configuration, the standing walls 92W and 93W reinforce the frame 90 with high reliability in cooperation with the reinforcement ribs 97.

In the image forming apparatus 1, as shown in FIG. 8, the edge 98R of the reinforcing wall 98 of the frame 90 located on one side in the width direction is connected to the support wall 96 located on the other side in the width direction with respect to the separation pad 23. With this configuration, the standing walls 92W and 93W reinforce the frame 90 with higher reliability in cooperation with the reinforcement ribs 97 and the reinforcing wall 98.

In the image forming apparatus 1, as shown in FIG. 6, the actuator 40 includes the shutter 42 connected to the rotation shaft 43 in the first region A1. The frame 90 supports, on the base wall 95, the sensor board 49 having the photosensor 48 for detecting the rotational position of the shutter 42. With this configuration, the frame 90 supports the sensor board 49 in the first region A1, which realizes a reduction in size in the width direction.

While the disclosure has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the disclosure, and not limiting the disclosure. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described disclosure are provided below.

Figure 14:
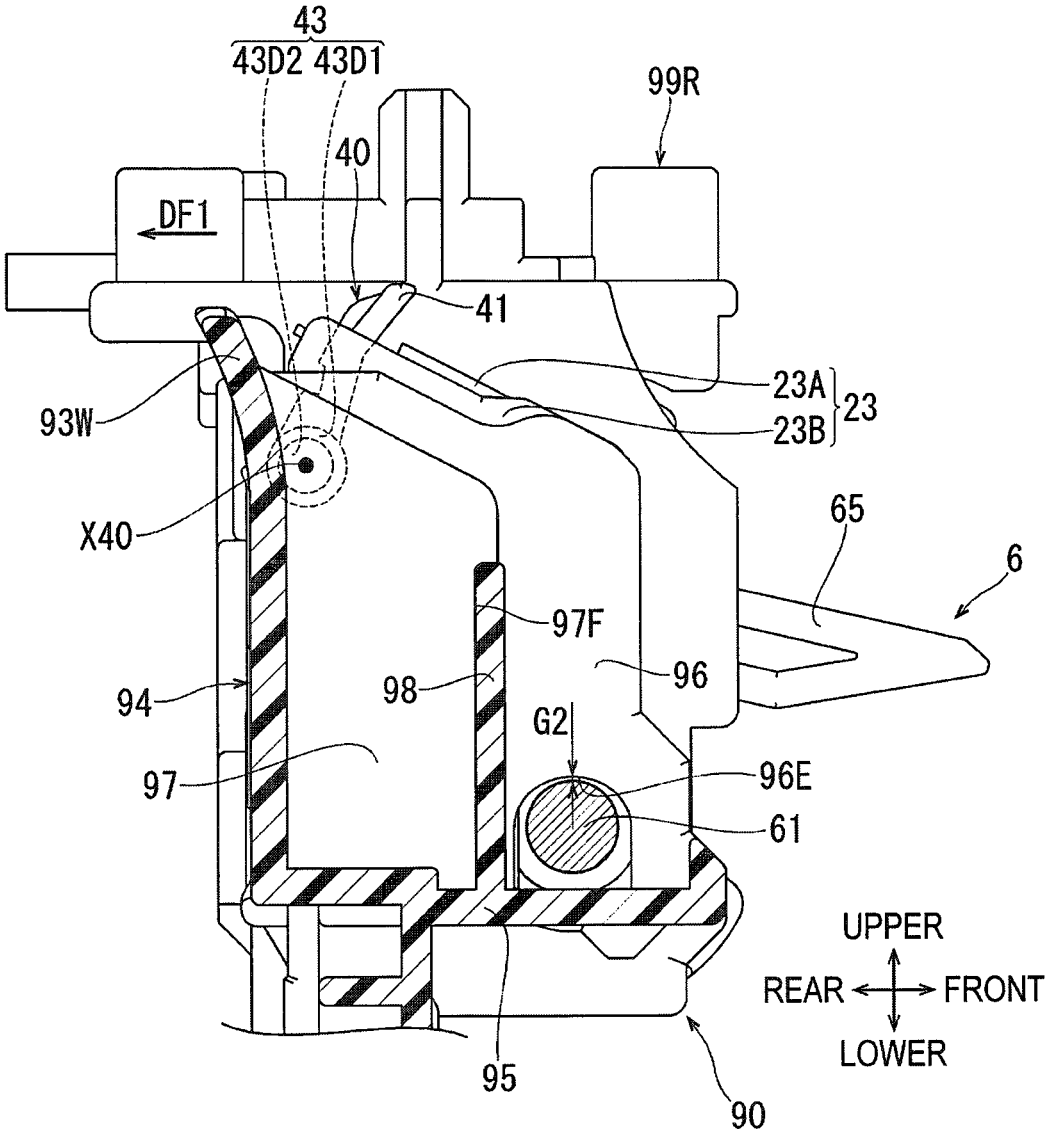
FIG. 14 is a cross-sectional view of an image forming apparatus, which is similar to FIG. 10.

As shown in FIG. 14, in an image forming apparatus of a modification, the gap G1 between the swing shaft 61 and the facing edge 96E according to the image forming apparatus 1 of the embodiment is changed, and a gap G2 between the swing shaft 61 and the facing edge 96E is made smaller than the gap G1.

The gap G2 is set to a size that allows the facing edge 96E to contact the swing shaft 61 made of metal when the frame 90 receives the reaction force F2 and bends downward.

The size of the gap G2 may be 0.1 mm to one and several-tenths of a millimeter, and may be 0.2 mm to 0.6 mm. In the present embodiment, the size of the gap G2 is 0.2 mm to 0.6 mm.

In the image forming apparatus of the modification, the swing shaft 61 made of metal and having high rigidity supports the frame 90 that has started to bend downward by receiving the reaction force F2. As a result, in the image forming apparatus, even if the frame 90 is bent, the amount of bending is reduced, which suppresses the frame 90 from being further bent.

In the embodiment, the sheet feeder of the present disclosure is embodied as the image forming apparatus 1, but the present disclosure is not limited to this configuration. For example, the configuration of the present disclosure may be applied to an image scanner (image reading apparatus), or may be applied to a multifunction peripheral including an image scanner at an upper side of an image forming apparatus.

In the embodiment, the urging spring 23S is a torsion coil spring, but the present disclosure is not limited to this configuration. For example, the urging spring 23S may be a compression coil spring.

In the embodiment, the facing edge 96E is a part of the inner peripheral edge of the hole through which the swing shaft 61 extends, but the present disclosure is not limited to this configuration. For example, a configuration may be adopted in which the lower end side of each support wall 96 is not connected to the base wall 95, and the lower edge of each support wall 96 is located above the swing shaft 61 and serves as the facing edge.

What is claimed is:

1. A sheet feeder comprising:

a separation roller configured to feed a sheet in a feed direction;

a separation pad facing the separation roller;

a spring configured to exert an urging force that presses the separation pad toward the separation roller;

an actuator configured to detect the sheet that is fed, the actuator including a rotation shaft and a contact piece, the rotation shaft having one end and an other end in a width direction perpendicular to the feed direction, the rotation shaft being rotatable about a rotation axis extending in the width direction, the contact piece being configured to contact the sheet and to rotate about the rotation axis together with the rotation shaft; and a frame configured to support the separation pad to contact and separate from the separation roller, the frame rotatably supporting the one end and the other end of the rotation shaft, the spring being located between the separation pad and the frame, the frame being configured to receive a downward reaction force that is a reaction force of the urging force, the rotation shaft and the contact piece being located at one side of the separation pad in the width direction, the frame having an upper edge in a first region defined between the one end and the other end of the rotation shaft in the width direction, a height of the upper edge in the first region being at a same height or below the rotation axis, the frame including a standing wall in a second region in the width direction, the standing wall extending farther upward than the upper edge in the first region, the second region including a region in which the separation pad is located, the second region being other than the first region.

2. The sheet feeder according to claim 1, wherein the standing wall extends farther upward than the rotation shaft.

3. The sheet feeder according to claim 1, wherein the standing wall has a portion overlapping the rotation shaft when viewed along the width direction.

4. The sheet feeder according to claim 1, wherein the rotation shaft includes:

a large-diameter portion connected to the contact piece; and a small-diameter portion located at the one side of the large-diameter portion in the width direction, the small-diameter portion having a smaller diameter than the large-diameter portion;

wherein the upper edge of the frame in the first region is located below the large-diameter portion in a range facing the large-diameter portion; and wherein the upper edge of the frame in the first region is located above a lower end of the small-diameter portion in a range facing the small-diameter portion.

5. The sheet feeder according to claim 1, further comprising:

a support plate configured to support the sheet to be fed;

a feed roller configured to feed the sheet supported by the support plate toward the separation roller;

a lifter including a driven cam, the lifter being configured to move the support plate up and down to contact and separate from the feed roller by a driving force transmitted via the driven cam;

a drive cam configured to transmit the driving force to the driven cam; and a gear frame supporting the drive cam, wherein the frame is coupled to the gear frame at a coupling end portion that is located at an other side of the separation pad in the width direction; and wherein the driven cam is supported by the frame at the coupling end portion.

6. The sheet feeder according to claim 5, wherein the lifter includes:

a swing shaft extending in the width direction, the driven cam being fixed to an end portion of the swing shaft on the other side in the width direction;

two swing gears fixed to the swing shaft at positions spaced apart from each other in the width direction; and two arms corresponding to the two swing gears in a one-to-one manner, the two arms being configured to move the support plate up and down by the driving force transmitted from the swing gears; and wherein the frame supports the swing shaft and the two arms so as to be swingable.

7. The sheet feeder according to claim 6, wherein the frame includes two support walls sandwiching the separation pad from outer sides in the width direction and supporting the separation pad; and wherein each of the two support walls has, at a lower end portion thereof, a facing edge facing the swing shaft from upward with a gap between the facing edge and the swing shaft.

8. The sheet feeder according to claim 7, wherein the swing shaft is made of metal; and wherein the gap is set to a size that allows the facing edge to contact the swing shaft when the frame receives the reaction force and bends downward.

9. The sheet feeder according to claim 1, wherein the frame includes:

two support walls sandwiching the separation pad from outer sides in the width direction and supporting the separation pad; and a plurality of reinforcement ribs located on an other side of the two support walls in the width direction, the plurality of reinforcement ribs being located upstream of the standing wall in the feed direction, the plurality of reinforcement ribs extending in an upper-lower direction at positions spaced apart from each other in the width direction; and wherein an upper end portion of each of the plurality of reinforcement ribs is connected to the standing wall.

10. The sheet feeder according to claim 9, wherein the frame includes a reinforcing wall connected to edges of the plurality of reinforcement ribs extending in the upper-lower direction, the edges of the plurality of reinforcement ribs being edges located upstream in the feed direction, the reinforcing wall extending in the upper-lower direction and the width direction; and wherein an edge of the reinforcing wall located on the one side in the width direction is connected to one of the support walls located on the other side of the separation pad in the width direction.

11. The sheet feeder according to claim 1, wherein the actuator includes a shutter connected to the rotation shaft in the first region, the shutter being rotatable together with the rotation shaft and the contact piece;

wherein the sheet feeder further comprises a sensor board including a photosensor configured to detect a rotation position of the shutter; and wherein the frame supports the sensor board.

12. The sheet feeder according to claim 1, wherein the frame includes a reinforcement shape portion below the separation pad, the reinforcement shape portion having an upper end surface in contact with one end of the spring, the separation pad being in contact with an other end of the spring; and wherein the reinforcement shape portion supports the one end of the spring and receives the reaction force of the spring.

13. The sheet feeder according to claim 12, wherein the frame includes a rear wall supporting the one end and the other end of the rotation shaft in the width direction, the rear wall extending in the width direction and an upper-lower direction, the rear wall being located on a downstream side of a friction member of the separation pad in the feed direction; and wherein the reinforcement shape portion is provided by forming a recess at a center portion of the rear wall in the width direction and forming a plurality of ribs inside the recess, the recess being recessed toward an upstream side in the feed direction.

14. An image forming apparatus comprising:

a sheet feeder; and a print engine configured to print an image on a sheet fed by the sheet feeder, the sheet feeder comprising:

a separation roller configured to feed a sheet in a feed direction;

a separation pad facing the separation roller;

a spring configured to exert an urging force that presses the separation pad toward the separation roller;

an actuator configured to detect the sheet that is fed, the actuator including a rotation shaft and a contact piece, the rotation shaft having one end and an other end in a width direction perpendicular to the feed direction, the rotation shaft being rotatable about a rotation axis extending in the width direction, the contact piece being configured to contact the sheet and to rotate about the rotation axis together with the rotation shaft; and a frame configured to support the separation pad to contact and separate from the separation roller, the frame rotatably supporting the one end and the other end of the rotation shaft, the spring being located between the separation pad and the frame, the frame being configured to receive a downward reaction force that is a reaction force of the urging force, the rotation shaft and the contact piece being located at one side of the separation pad in the width direction, the frame having an upper edge in a first region defined between the one end and the other end of the rotation shaft in the width direction, a height of the upper edge in the first region being at a same height or below the rotation axis, the frame including a standing wall in a second region in the width direction, the standing wall extending farther upward than the upper edge in the first region, the second region including a region in which the separation pad is located, the second region being other than the first region.

* * * * *